US011730653B2

(12) United States Patent
Liang et al.

(10) Patent No.: US 11,730,653 B2
(45) Date of Patent: Aug. 22, 2023

(54) BRAKING DEVICE FOR OPERATING TABLE BASE

(71) Applicant: AMTAI MEDICAL EQUIPMENT, INC, Raleigh, NC (US)

(72) Inventors: Clay Liang, Raleigh, NC (US); Chien-Cheng Su, New Taipei (TW)

(73) Assignee: AMTAI MEDICAL EQUIPMENT, INC, Raleigh, NC (US)

( * ) Notice: Subject to any disclaimer, the term of this patent is extended or adjusted under 35 U.S.C. 154(b) by 48 days.

(21) Appl. No.: 17/231,090

(22) Filed: Apr. 15, 2021

(65) Prior Publication Data

US 2021/0322245 A1 Oct. 21, 2021

(30) Foreign Application Priority Data

Apr. 15, 2020 (TW) ..... 109112629

(51) Int. Cl.
*A61G 13/02* (2006.01)
*A61G 13/10* (2006.01)

(52) U.S. Cl.
CPC ..... *A61G 13/104* (2013.01); *A61G 13/02* (2013.01)

(58) Field of Classification Search
CPC ..... A61G 13/104; A61G 13/00; A61G 13/02; A61G 13/10
See application file for complete search history.

(56) References Cited

U.S. PATENT DOCUMENTS

2012/0304383 A1* 12/2012 Marugg ..... A61G 13/104 5/600

* cited by examiner

*Primary Examiner* — Fredrick C Conley
(74) *Attorney, Agent, or Firm* — Locke Lord LLP; Tim Tingkang Xia, Esq.

(57) ABSTRACT

The present invention provides a braking device for an operating table base, comprising at least two supporting legs, each supporting leg having a pivoting end and a supporting end distanced from the pivoting end. The operating table base supports an operation bed whose projected area covers the operating table base. The operating table base has a first pivoting portion corresponding to each supporting leg, and each supporting leg has a second pivoting portion at the pivoting end to correspond to the first pivoting portion of the operating table base. The first pivoting portion pivotally connects to the second pivoting portion, so that each supporting leg rotates with respect to the operating table base. The supporting ends of the supporting legs extend a supporting area of the operating table base.

18 Claims, 9 Drawing Sheets

BRAKING DEVICE FOR OPERATING TABLE BASE

FIELD OF THE INVENTION

The present invention relates to a braking device for an operating table base, and more particularly, to a braking device that prevents an operation bed from tipping over when a part of it is to be replaced by a carbon fiber bed board.

DESCRIPTION OF THE PRIOR ART

Nowadays, it is generally acknowledged that 3-dimensional visual perception with the aid of robot arm-positioning has become the mainstream in medical operation intended to minimize invasive surgery procedures. The structure of a conventional operation bed is made of metal materials, and thereby preventing 3-demenetional image capture of the table body through 360-degree X-ray. As a result, a general practice of surgery teams is to remove the rear part of a conventional operation bed, or the part where the face-up lying patient resting his/her butt and feet. The removed part of the operation bed is replaced by a carbon fiber bed board that allows 3-dementional images to be captured through 360-degree X-ray. This removal and replacement of a part of the operation bed is the common clinical practice at the moment.

Nevertheless, the aforementioned clinical solution increases a risk that the operation bed may tip over in the direction of the carbon fiber bed board. Therefore, a supporting leg to be fixed at the end of or beneath the carbon fiber bed board is required to reduce the risk of the operation bed tipping over during a surgery. However, such a solution causes usage inconvenience. For example, it is very troublesome to adjust the bed height or angle during a surgery, and a user should remove the sterile sheet covering the patient and the supporting leg before adjusting the supporting leg to the desired height and angle at the same time. Besides, this solution is prone to a new risk of product injury. For example, if a user fails to see the supporting leg that has been covered with a sterile sheet, and only adjusts the height or angle of the operation bed, without adjusting the height or angle of the supporting leg at the same time, the user will put the operation bed, carbon fiber bed board, or supporting leg in the risk of damage.

Therefore, there is truly a dire need in the medical sector to address the issue that the operation bed may tip over when a part of it is to be replaced by a carbon fiber bed board.

SUMMARY OF THE INVENTION

To tackle problems with prior art operating tables, the present invention employs a metal-based braking device mounted on an operating table base. The braking device is rotatable to any direction outside the operating table base, as a way to extend the pivot point of the base loading, without expanding the length or width of the operating table base. The result is, when the carbon fiber bed board replaces part of the operation bed, there is no need to install a supporting stand at the end or underneath the carbon fiber bed board, and therefore the operation bed is free from the risk of tipping over during a surgery. Moreover, the braking device according to the present invention does not increase the length or width of the operating table base, and thus, it does not affect the space required by the surgery team during the surgery. Besides, the braking device of the invention is rotatable in variable directions, and the surgery team is free to utilize the space available in the surgery and to extend the pivot point of the operating table base, ensuring a smooth surgery process as well as stable loading of the operating table.

An objective of this invention is to provide a braking device that prevents an operation bed from tipping over when a part of it is to be replaced by a carbon fiber bed board.

To achieve the objective above, the invention provides a braking device for an operating table base, comprising at least two supporting legs, each supporting leg having a pivoting end and a supporting end distanced from the pivoting end. The operating table base supports an operation bed whose projected area covers the operating table base. The operating table base has a first pivoting portion corresponding to each supporting leg, and each supporting leg has a second pivoting portion at the pivoting end to correspond to the first pivoting portion of the operating table base. The first pivoting portion pivotally connects to the second pivoting portion, so that each supporting leg rotates with respect to the operating table base. The supporting ends of the supporting legs extend a supporting area of the operating table base.

Preferably, at least two of the supporting legs are provided separately at two corners of the operating table base.

Preferably, two of the supporting legs are provided separately at two corners at one end of the operating table base, and another supporting leg is provided at the other end of the operating table base.

To achieve the objective stated above, the invention further provides a braking device for an operating table base, comprising at least two ancillary portions and at least two supporting legs corresponding to the ancillary portions; each supporting leg has a pivoting end and a supporting end distanced from the pivoting end. The operating table base supports an operation bed whose projected area covers the operating table base. Each ancillary portion is fixed either beneath or at an outer side of a turning corner where two outside surfaces of the operating table base intersect. Each ancillary portion has a first pivoting portion, and each supporting leg has a second pivoting portion at the pivoting end to correspond to the first ancillary portion. The first pivoting portion pivotally connects to the second pivoting portion, so that each supporting leg rotates with respect to the operating table base. The supporting ends of the supporting legs extends a supporting area of the operating table base.

Preferably, two of the supporting legs, by means of the ancillary portion, are provided either beneath or at an outer side of two corners where outside surfaces of the operating table base intersect, the two corners being on the same side as a rear end of the operating table base, and another supporting leg is fixed at an edge of the operating table base, the edge being on the same side as a front end of the operating table.

Preferably, the supporting leg further comprises a base body and a base cushion, the second pivoting portion being provided on the base body, and wherein the base cushion is positioned in a manner that allows it to be completely disposed on the base body and correspond to an extension of the base body from the second pivoting portion to the other end, so as to prevent a pivot point between each supporting leg and the operating table base from moving inward when each supporting leg rotates to a position parallel to or beneath the operating table base.

Preferably, the first pivoting portion is a shaft and the second pivoting portion is a shaft sleeve, and wherein the base body is made of metal and the base cushion is made of a non-metal material with elasticity and electrostatic conductivity so as to increase friction during braking and simultaneously create a path for static electricity to be discharged to the ground of an operating room.

Preferably, the first pivoting portion is an internal threaded structure and the second pivoting portion an external threaded structure, wherein rosette gears that can be mutually coupled are provided on the respective contact surfaces where the first pivoting portion and the second pivoting portion contact each other.

In the invention, the braking device for an operating table base further comprises a lifting mechanism. Underneath the operating table base, a caster is provided at an edge of the operating table base adjacent to each first pivoting portion, and the lifting mechanism is employed to move the casters underneath the operating table base upward or downward.

Preferably, when the lifting mechanism is employed to move the casters upward, the supporting legs go downward to touch the ground, so that the braking device performs a braking action.

Preferably, when the lifting mechanism is employed to move the casters downward to touch the ground, the supporting legs go upward, so that the braking device performs a brake-releasing action.

In the invention, the braking device for an operating table base further comprises a lifting mechanism. Underneath the operating table base, a caster is provided at an edge of the operating table base adjacent to each first pivoting portion, and the lifting mechanism is employed to move the supporting legs upward or downward.

Preferably, when the lifting mechanism is employed to move the supporting legs upward, the casters go downward to touch the ground, so that the braking device performs a brake-releasing action.

Preferably, when the lifting mechanism is employed to move the supporting legs to move downward to touch the ground, the casters go upward, so that the braking device performs a braking action.

BRIEF DESCRIPTION OF THE DRAWINGS

FIG. 7A shows the first and second pivoting portions separated and FIG. 7B shows the two pivoting portions assembled.

DETAILED DESCRIPTION OF THE PREFERRED EMBODIMENTS

Figure 1:
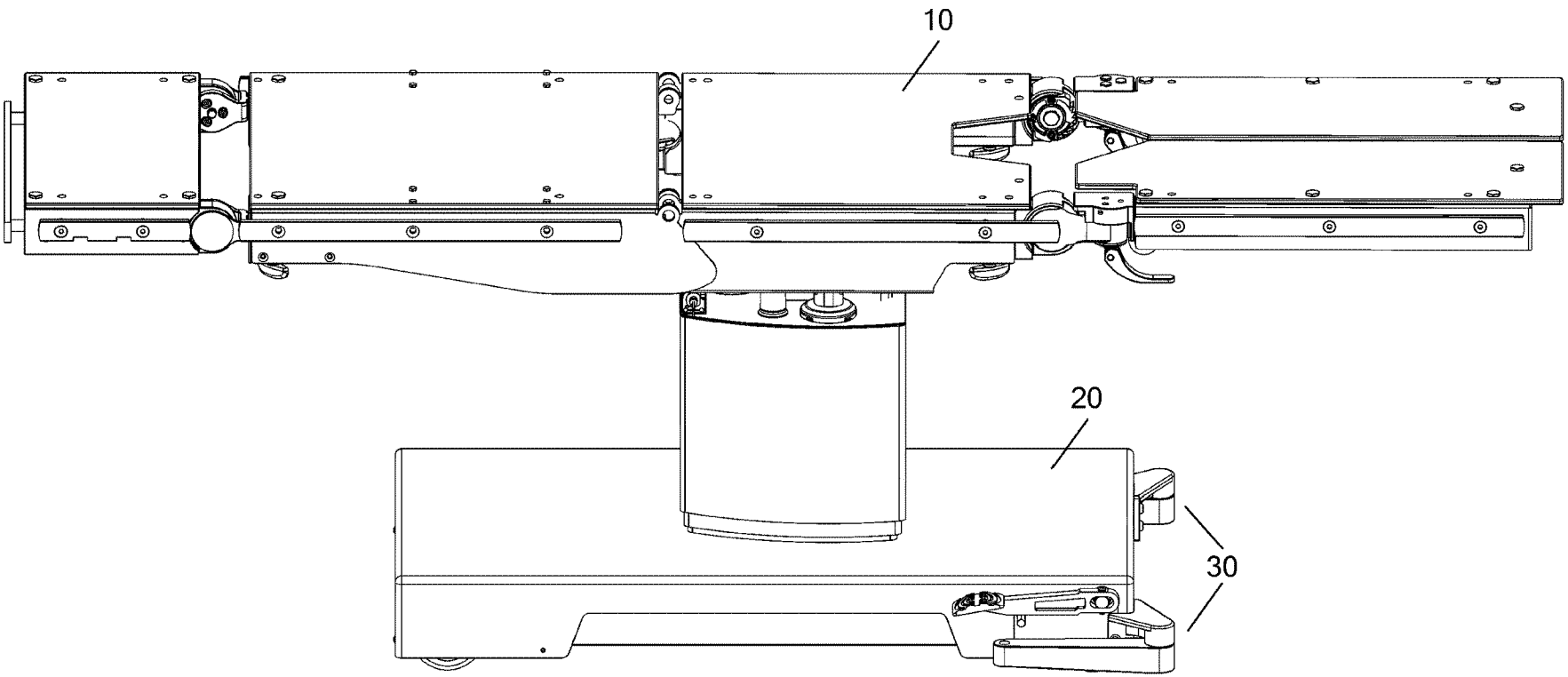
FIG. 1 is a perspective view of an operating table that comprises a braking device for the operating table base according to the invention.

FIG. 1 shows a perspective view of an operating table that utilizes a braking device for the operating table base according to the invention. The operating table comprises an operation bed 10, under which is a base 20, and a braking device 30 is provided at the corners of the base 20 to strengthen stability of the operating table.

Figure 2:
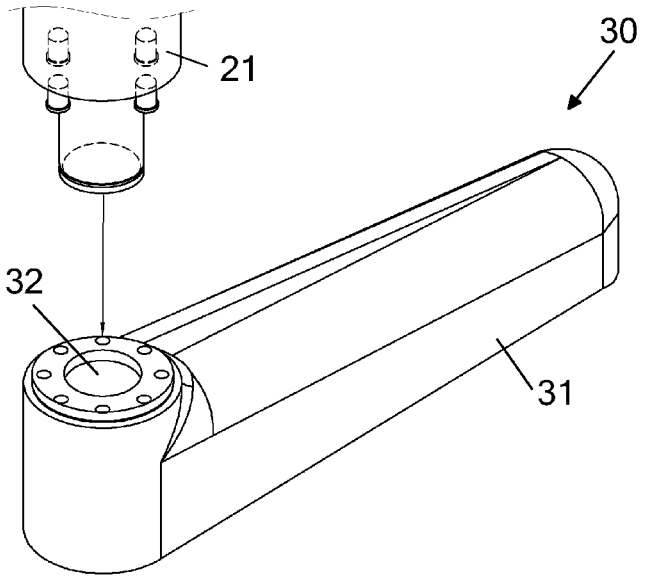
FIG. 2 is a perspective view of the supporting leg of the braking device for the operating table base according to the invention.

FIG. 1 shows the braking device 30 for the operating table base comprises at least two supporting legs 31; each of the supporting legs 31 has one pivoting end and one supporting end distanced from the pivoting end. The operating table base 20 supports the operation bed 10, a projected area of which covers the base 20. FIG. 2 is a perspective view of a supporting leg of the braking device for the operating table base according to the invention. The operating table base 20 has a first pivoting portion 21 corresponding to the supporting leg 31; the supporting leg 31 has a second pivoting portion 32 at the pivoting end to correspond to the first pivoting portion 21 of the operating table base 20. The first pivoting portion 21 pivotally connects to the second pivoting portion 32, thereby allowing the supporting leg 31 to rotate with respect to the operating table base 20. The supporting ends of the supporting legs 31 extend the supporting area of the operating table base 20.

Figure 3:
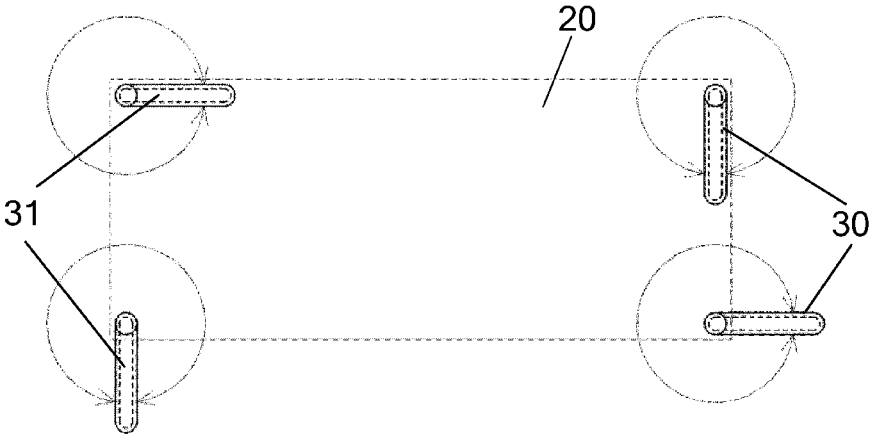
FIG. 3 is a schematic view of the braking device for the operating table base according to the first embodiment of the invention.

FIG. 3 is a schematic view of the braking device for the operating table according to the first embodiment of the invention. In FIG. 3, only the operating table base 20 and supporting legs 31 are shown to give a clearer explanation. In this embodiment, the braking device 30 comprises four supporting legs 31; each of the supporting legs 31 has one pivoting end and one supporting end distanced from the pivoting end. The pivoting end of each supporting leg 31 is located at each of the four corners of the operating table base 20. The first pivoting portion 21 of the operating table base and the second pivoting portion 32 of the supporting leg 31 together function as a pivot point, which allows 360-degree rotation of the supporting end of the supporting leg 31 with respect to the operating table base 20. As a result, when operating the braking device 30 for the operating table base according to the invention, the user could, according to the actual needs, freely adjust the rotation angle of the supporting end of each supporting leg 31 on the braking device 30, so that the supporting ends of the supporting legs 31 can extend the supporting area of the operating table base 20, and henceforth strengthen stability of the operating table during a surgery.

Figure 4:
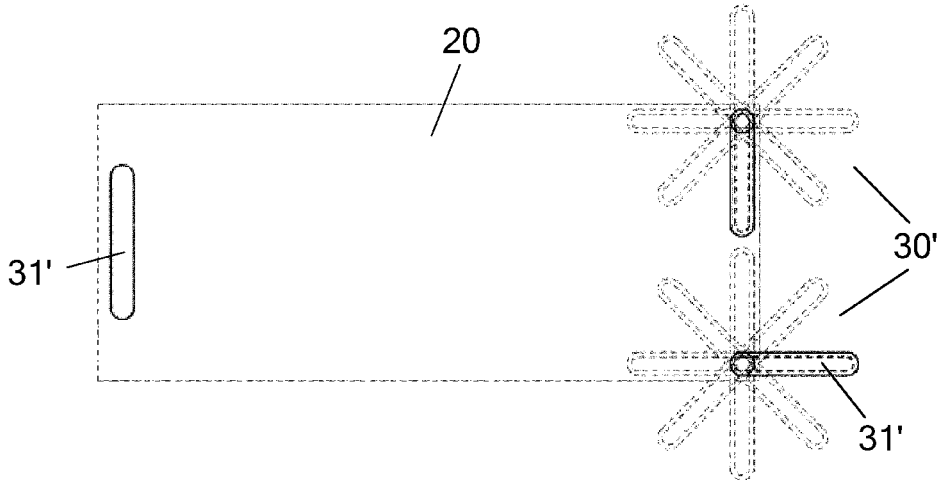
FIG. 4 is a schematic view of the braking device for the operating table base according to the second embodiment of the invention.

FIG. 4 is a schematic view showing the braking device for the operating table base according to the second embodiment of the invention. The structure of the braking device 30' for the operating table base according to the second embodiment is roughly identical to the structure of the braking device 30 for the operating table base according to the first embodiment; the difference lies in the positions of the supporting legs 31'. In this second embodiment, the braking device 30' comprises three supporting legs 31'; two of those supporting legs 31' are arranged at two corners of the operating table base 20, the two corners being on the same side as the rear end of the operating table, while the other supporting leg 31' is fixed at an edge of the operating table base, the edge being on the same side as the front end of the operating table. Likewise, the pivoting ends of the supporting legs 31' can make 360-degree rotation with respect to the operating table base 20; when operating the braking device 30' for the operating table base according to the invention, the user could, according to the actual needs, freely adjust the rotation angle of the supporting end of each supporting leg 31' on the braking device 30', so that the supporting ends of the supporting legs 31' can extend the supporting area of the operating table base 20, and henceforth strengthen stability of the operating table during a surgery. Moreover, in this embodiment, the supporting leg 31', which is fixed at the edge of the operating table base 20 on the same side as the front end of the operating table, is not limited to being rotatable in design; it can also be non-rotatable, fixed at the edge of the operating table base 20.

Figure 5:
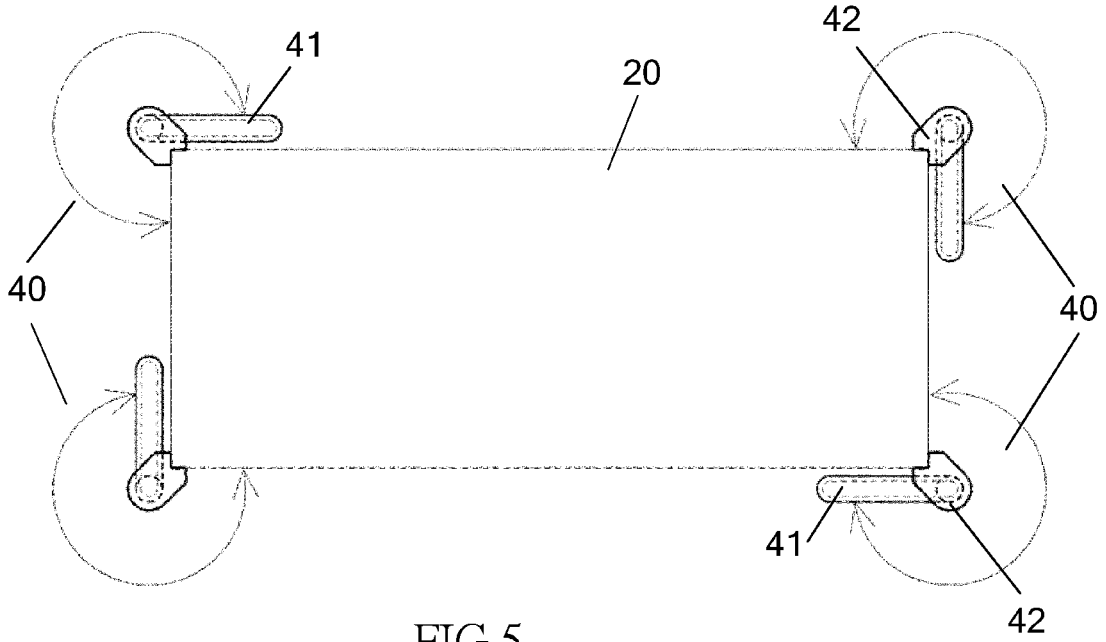
FIG. 5 is a schematic view of the braking device for the operating table base according to the third embodiment of the invention.

FIG. 5 is a schematic view of the braking device for the operating table base according to the third embodiment of the invention. In FIG. 5, only the operating table base and supporting legs are shown to give a clearer explanation. In this embodiment, the braking device 40 for the operating table base comprises four supporting legs 41, and each of the supporting legs 41 has one pivoting end and one supporting end distanced from the pivoting end; the operating table base 20 supports the operation bed 10, a projected area of which covers the base 20 (See FIG. 1). For each supporting leg 41 there is one corresponding ancillary portion 42; the ancillary portion 42 is fixed either beneath or at the outer side of the turning corner where two outside surfaces of the operating table base 20 intersect. The ancillary portion 42 has a first pivoting portion 43, and the supporting leg 41, at its pivoting end, has a second pivoting portion 44 corresponding to the first pivoting portion 43 of the ancillary portion 42. The first pivoting portion 43 pivotally connects to the second pivoting portion 44, thereby allowing the supporting leg 41 to rotate with respect to the ancillary portion 42. The first pivoting portion 43 of the ancillary portion 42 and the second pivoting portion 44 of the supporting leg 41 together function as a pivoting point, which allows the supporting end of the supporting leg 41 to rotate 360 degrees with respect to the ancillary portion 42. When operating the braking device 40 for the operating table base according to the invention, the user could, according to the actual needs, freely adjust the rotation angle of the supporting end of each supporting leg 41 on the braking device 40, so that the supporting ends of the supporting legs 41 can extend the supporting area of the operating table base 20, and henceforth strengthen stability of the operating table during a surgery.

Figure 6:
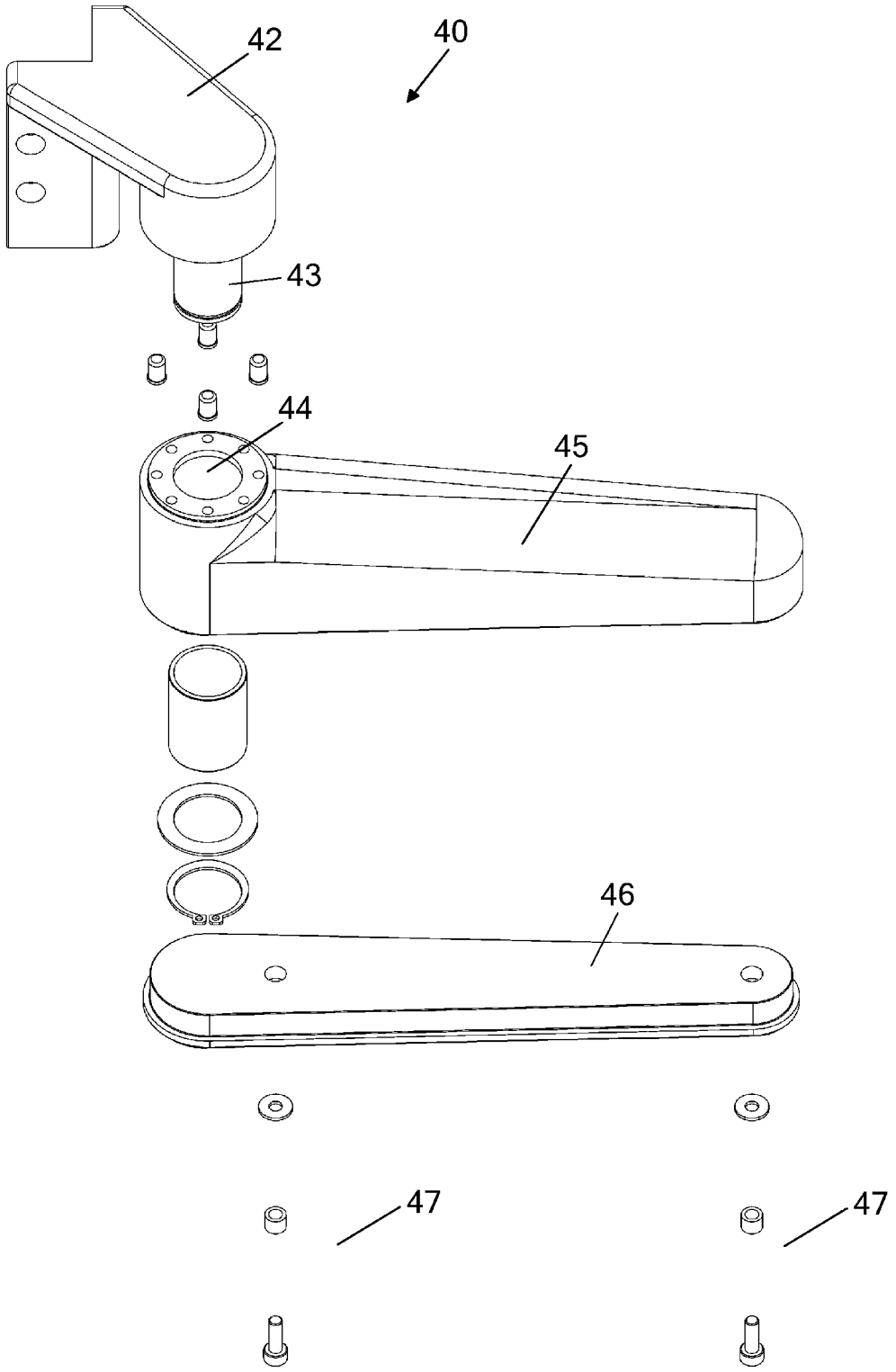
FIG. 6 is an exploded perspective view of the supporting leg of the braking device for the operating table base according to the invention.

Please see FIGS. 5 and 6. FIG. 6 is an exploded perspective view of the supporting leg of the braking device for the operating table base according to the invention. The supporting leg 41 further comprises a base body 45 and a base cushion 46, which is disposed on the base cushion 46; the base body 45 and the base cushion 46 are fastened together with a fastening member 47. The second pivoting portion 44 is provided on the base body 45, to be connected to the first pivoting portion 43 of the ancillary portion 42, wherein the first pivoting portion 43 is a shaft, and the second pivoting portion 44 is a shaft sleeve, so that the shaft can be fitted and fastened into the shaft sleeve and the two elements are pivotally connected.

Figure 7A:
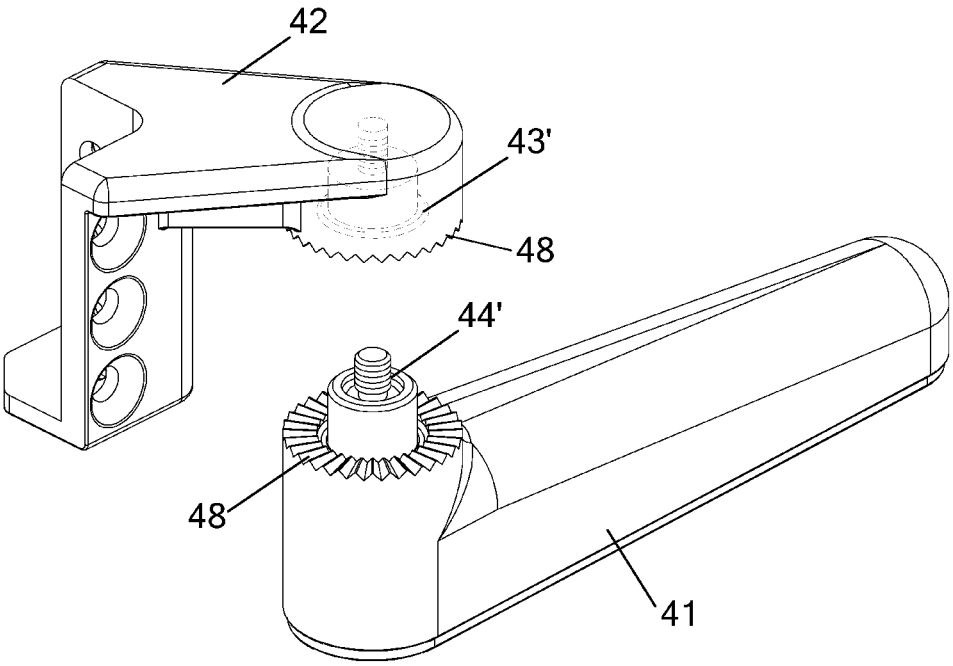
FIGS. 7A and 7B are perspective views showing the first pivoting portion of an ancillary portion and the second pivoting portion of a supporting leg of the braking device for the operating table base according to another embodiment of the invention.
Figure 7B:
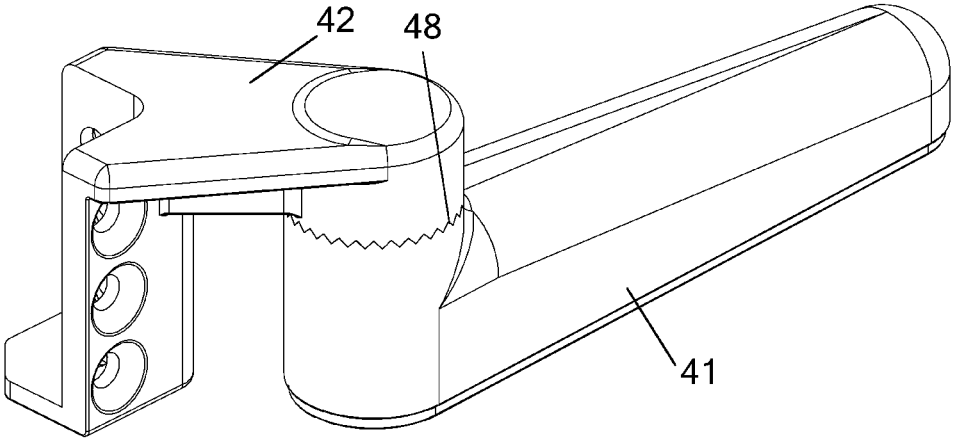

Please see FIGS. 7A and 7B while referencing FIG. 6. FIGS. 7A and 7B are perspective views showing the first pivoting portion of an ancillary portion and the second pivoting portion of a supporting leg of the braking device for the operating table base according to another embodiment of the invention; FIG. 7A shows the first and second pivoting portions separated and FIG. 7B shows the two pivoting portions assembled. As shown in FIG. 7A, the first pivoting portion 43' is an internal threaded structure and the second pivoting portion 44' is an external threaded structure, so that the external threads engage with and are fastened to the internal threads when the two pivoting portions are assembled. Moreover, rosette gears that can be mutually coupled are provided on the respective contact surfaces where the first pivoting portion 43' and the second pivoting portion 44' contact each other, as shown in FIG. 7B. When a section of the operation bed 10 needs to be replaced with a carbon fiber bed board 50, the ancillary portions 42 and the supporting legs 41 must be under heavy pressure, which may result in sliding or shaking of them. Therefore, the rosette gears provided on the respective contact surfaces are basically designed to address this issue. By mutual engagement between the rosette gear 48 on the contact surface of the first pivoting portion 43' and the rosette gear 48 on the contact surface of the second pivoting portion 44', enhanced fastening can be achieved at the position where an ancillary portion 42 and a supporting leg 41 are coupled to each other. This can help prevent the operating table base 20 from sliding or shaking, thereby strengthening stability of the operating table.

Please continue to see FIGS. 6, 7A and 7B. The supporting leg 41 further comprises a positioning mechanism (not shown in the drawing; please refer to FIG. 4 for a schematic view of its operation). The positioning mechanism is used for adjusting the rotation angle of the supporting end of the supporting leg 41 with respect to the operating table base 20 as well as the ancillary portion 42 (please refer to the dotted lines shown in FIG. 4), thereby allowing the supporting end of the supporting leg 41 to rotate in multiple stages, and henceforth strengthening stability of the operating table base during a surgery. Furthermore, the base cushion 46 is positioned in a manner that allows it to be completely disposed on the base body 45 and correspond to the extension of the base body 45 from the second pivoting portion 44 to the other end thereof. This prevents the pivot point between each supporting leg 41 and the operating table base 20 from moving inward when the supporting leg 41 rotates to a position parallel to the operating table base 20 or beneath it, eventually enhancing the stability of the operation bed 10 during a surgery. Moreover, the base body 45 is made of metal while the base cushion 46 is made of a non-metal material with elasticity and electrostatic conductivity, thereby increasing friction during the braking action and simultaneously creating a path for static electricity to be discharged to the ground.

Figure 8:
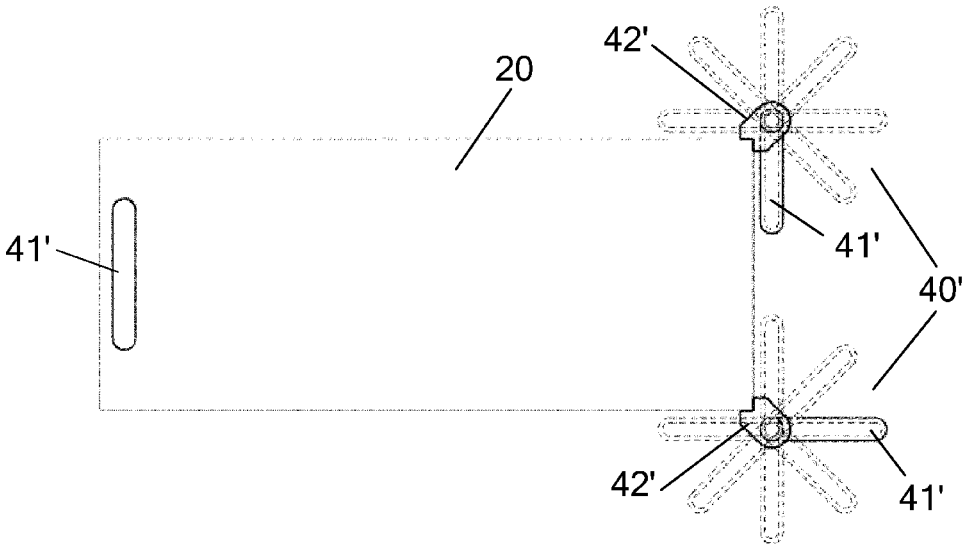
FIG. 8 is a schematic view of the braking device for the operating table base according to the fourth embodiment of the invention.

Please see FIG. 8, which is a schematic view of the braking device for the operating table base according to the fourth embodiment of the invention. The structure of the braking device 40' for the operating table base according to this (fourth) embodiment is roughly identical to the structure of the braking device 40 for the operating table base according to the fifth embodiment; the difference lies in the positions of the supporting legs 41'. In this embodiment, the braking device 40' comprises three supporting legs 41'; two of the supporting legs 41', by means of the ancillary portions 42', are fixed either beneath or at the outer side of the turning corners where two outside surfaces of the operating table base 20 intersect, the two corners being on the same side as the rear end of the operating table. The two supporting legs 41' can make 360-degree rotation with respect to the operating table base 20. When operating the braking device 40' for the operating table base according to the invention, the user could, according to the actual needs, freely adjust the rotation angles of the two supporting legs 41' of the braking device 40'. By contrast, the other supporting leg 41' is fixed at an edge of the operating table base 20, the edge being on the same side as the front end of the operating table, so as to strengthen stability of the operating table during a surgery.

Figure 9:
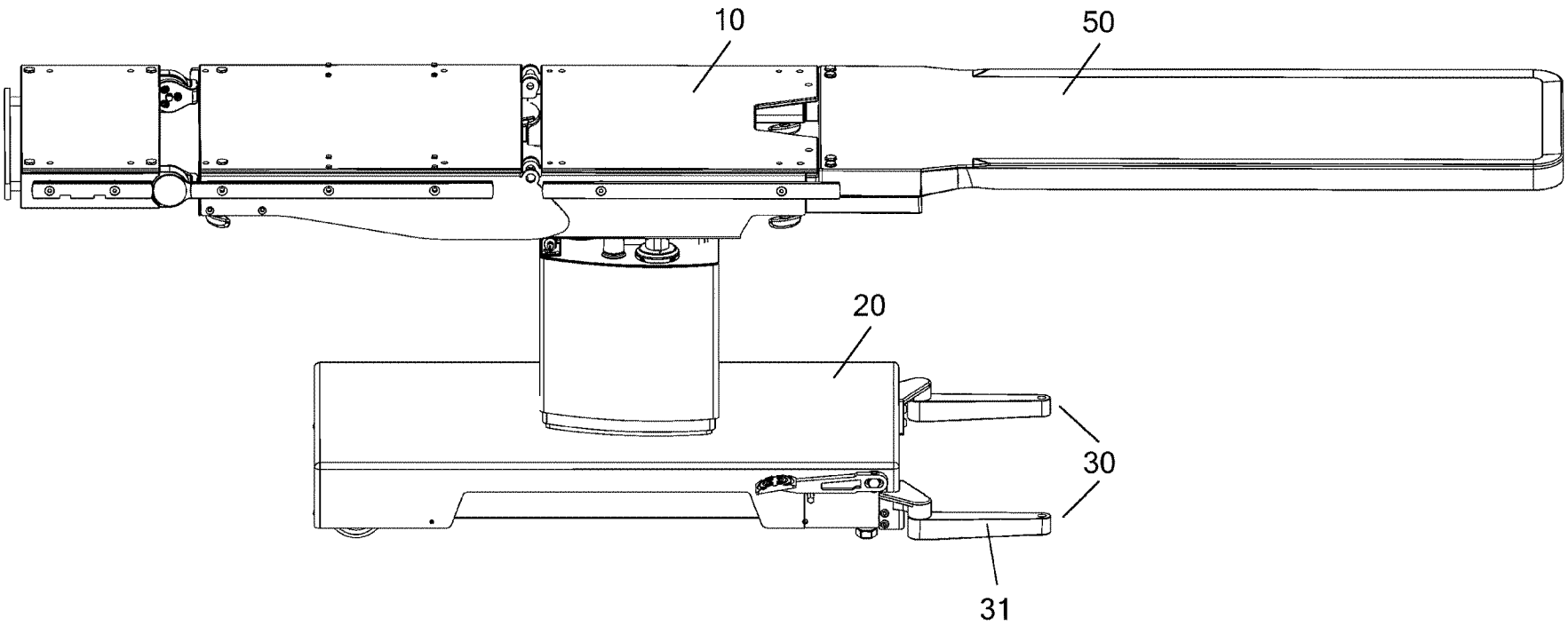
FIG. 9 is a schematic perspective view showing the braking device for the operating table according to the invention in operation.

Please see FIG. 9, which is a schematic perspective view showing the braking device for the operating table according to the invention in operation. When a patient needs an X-ray scanning during a surgery, medical staff may need to replace a section of the operation bed 10 (see FIG. 1) where the patient places his/her legs with a carbon fiber bed board 50. Over the course of bed change, the medical staff can use the positioning mechanism of the braking device 30, and by adjusting the first pivoting portion 21 and second pivoting portion 32 (see FIG. 2), to make the supporting ends of the supporting legs 31, which are located at the two corners at the operating table base end near the carbon fiber bed board 51, turn 180 degrees. Rotation of the supporting legs 31 allows them to be positioned parallel to the operating table bed 10, thereby supporting the newly changed carbon fiber bed board 50 to prevent it from tipping over.

Figure 10A:
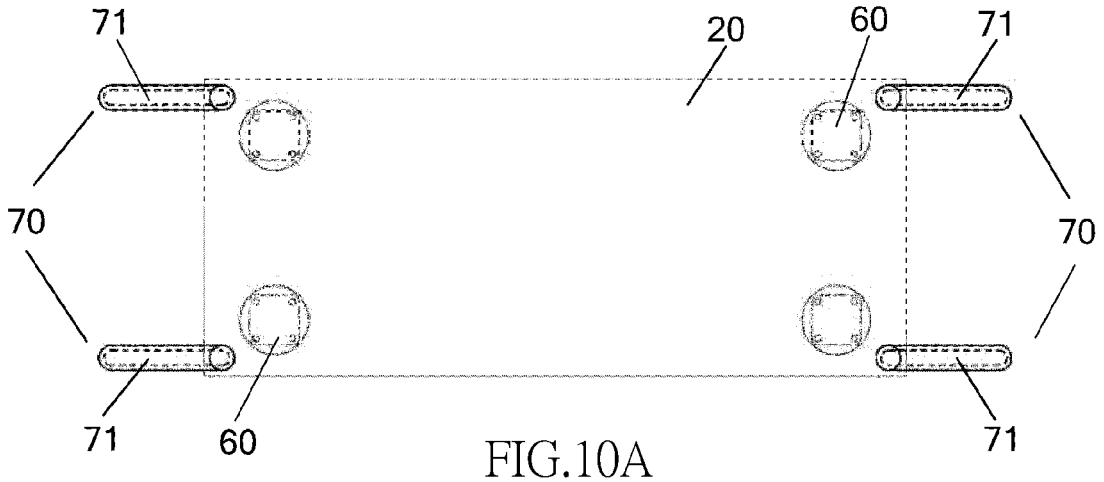
FIGS. 10A to 10C are schematic views of the braking device for the operating table base according to the fifth embodiment of the invention.
Figure 10B:
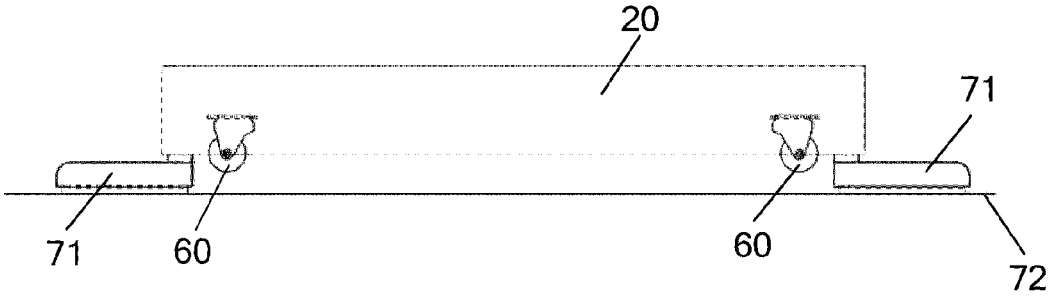
Figure 10C:
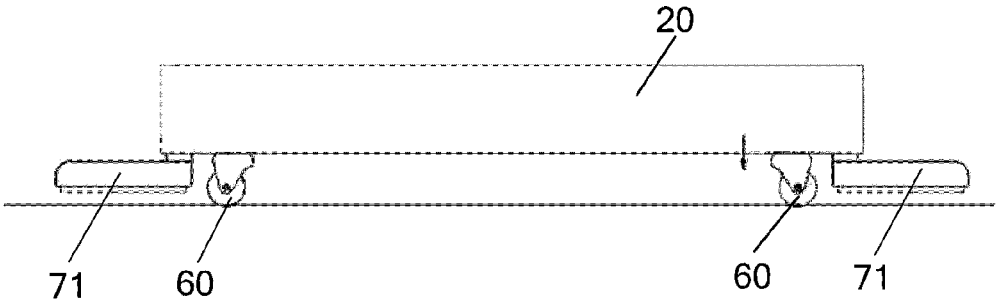

Please see FIGS. 10A to 10C, which are schematic views of the braking device for the operating table base according to the fifth embodiment of the invention. In each of these drawings, only the operating table base and the supporting legs are shown to give a clearer explanation. In this embodiment, a first pivoting portion is provided at each of the four corners of the operating table base 20, and underneath the operating table base 20, a caster 60 is provided at its edge adjacent to each first pivoting portion 21. The braking device 70 comprises four supporting legs 71, and each of the supporting legs 71 has one pivoting end and one supporting end distanced from the pivoting end. The pivoting ends of the supporting legs 71 are located at the four corners of the operating table base 20, and the supporting leg 71, at its pivoting end, has a second pivoting portion 32 corresponding to the first pivoting portion 21 of the operating table base 20 (Please see FIG. 2). The first pivoting portion 21 pivotally connects to the second pivoting portion 32. The first pivoting portion 21 of the operating table base 20 and the second pivoting portion 32 of the supporting leg 71 together function as a pivot point, which allows the supporting end of the supporting leg 71 to rotate with respect to the operating table base 20. As a result, when operating the braking device 70 for the operating table base according to the invention, the user could, according to the actual needs, freely adjust the rotation angle of the supporting end of each supporting leg 71 on the braking device 70, so that the supporting ends of the supporting legs 71 can extend the supporting area of the operating table base 20, and henceforth strengthen stability of the operating table during a surgery.

Please continue to see FIGS. 10A to 10C. In this (fifth) embodiment, the operating table base further comprises a lifting mechanism (not shown in the drawings) for moving the casters 60 underneath the operating table base 20 upward or downward, so that the braking device 70 for the operating table base according to the invention can achieve the braking or brake-releasing function. As shown in FIG. 10B, when the casters 60 go upward with the aid of the lifting mechanism, the supporting legs 71 as a result go downward to touch the ground 72, and the braking device 70 for the operating table base according to the invention can achieve the braking function. Likewise, as shown in FIG. 10C, when the casters 60 go downward to touch the ground 72 with the aid of the lifting mechanism, the supporting legs 71 as a result go upward, and the braking device 70 for the operating table base according to the invention can achieve the brake-releasing. Moreover, the lifting mechanism in this embodiment is a technique that a person having ordinary skill in the art would comprehend and understand, and therefore is not shown in a drawing or explained repeatedly herein.

Figure 11A:
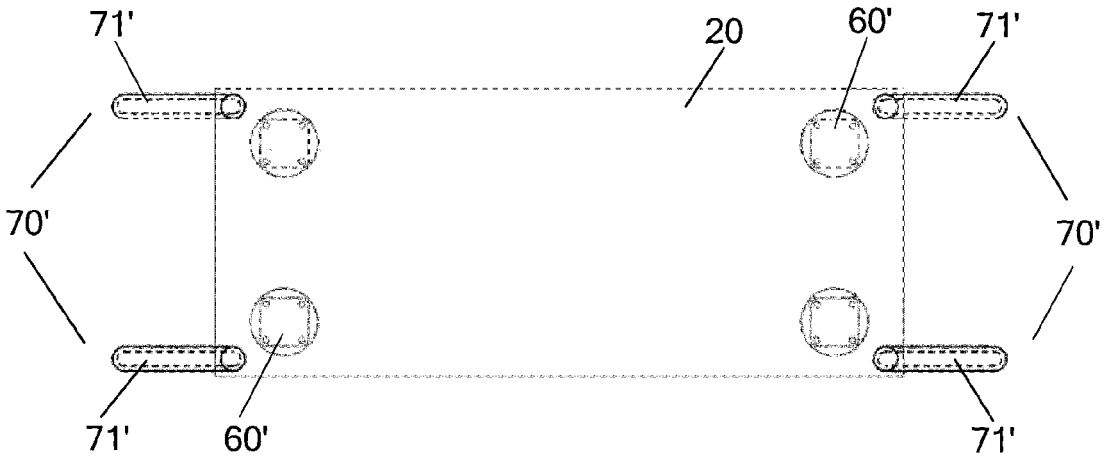
FIGS. 11A to 11C are schematic views of the braking device for the operating table base according to the sixth embodiment of the invention.
Figure 11B:
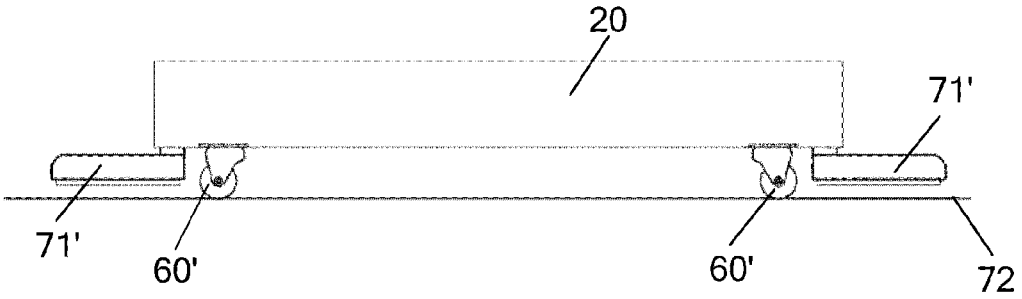
Figure 11C:
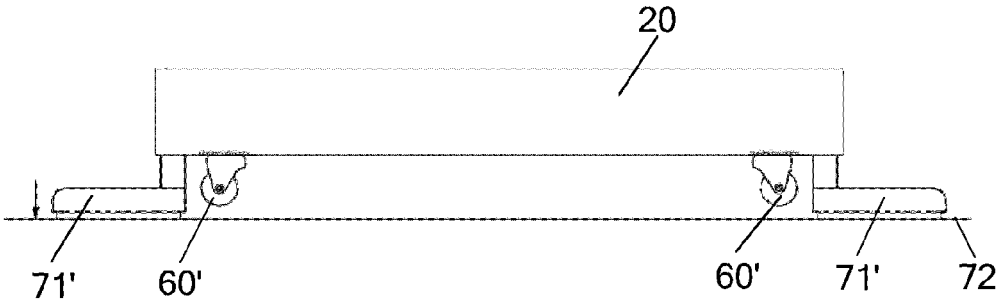

Please see FIGS. 11A and 11B, which are schematic views of the braking device for the operating table base according to the sixth embodiment of the invention. The structure of the braking device 70' for the operating table base according to the sixth embodiment is roughly identical to the structure of the braking device for the operating table base according to the fifth embodiment shown in FIGS. 10A to 10C. The difference lies in that the lifting mechanism of the operating table base 20 in this embodiment is employed to move the supporting legs 71' upward or downward, so that the braking device 70' for the operating table base according to the invention can achieve the braking or brake-releasing function. As shown in FIG. 11B, with the aid of the lifting mechanism, when the supporting legs 71' go upward, the casters 60' as a result go downward to touch the ground 72, so that the braking device 70' for the operating table base according to the invention can achieve the brake-releasing function. Likewise, as shown in FIG. 11C, when the supporting legs 71' go downward to touch the ground 72 with the aid of the lifting mechanism, the casters 60' as a result go upward, so that the braking device 70' for the operating table base according to the invention can achieve the braking function.

What is claimed is:

1. A braking device for an operating table base, comprising at least two supporting legs and a lifting mechanism, each supporting leg having a pivoting end and a supporting end distanced from the pivoting end, the operating table base supporting an operation bed whose projected area covers the operating table base, the operating table base having a first pivoting portion corresponding to each supporting leg, each supporting leg having a second pivoting portion at the pivoting end to correspond to the first pivoting portion of the operating table base, the first pivoting portion pivotally connecting to the second pivoting portion, so that each supporting leg rotates with respect to the operating table base, and the supporting ends of the supporting legs extend a supporting area of the operating table base, and underneath the operating table base, a caster is provided at an edge of the operating table base adjacent to each first pivoting portion, and the lifting mechanism is employed to move the casters underneath the operating table base upward or downward.

2. The braking device for an operating table base of claim 1, wherein at least two of the supporting legs are provided separately at two corners of the operating table base.

3. The braking device for an operating table base of claim 1, wherein two of the supporting legs are provided at two corners at one end of the operating table base, and another supporting leg is provided at an edge at another one end of the operating table base.

4. The braking device for an operating table base of claim 1, wherein the supporting leg further comprises a base body and a base cushion, the second pivoting portion being provided on the base body, and wherein the base cushion is positioned in a manner that allows it to be completely disposed on the base body and correspond to an extension of the base body from the second pivoting portion to another one end, so as to prevent a pivot point between each supporting leg and the operating table base from moving inward when each supporting leg rotates to a position parallel to or beneath the operating table base.

5. The braking device for an operating table base of claim 4, wherein the first pivoting portion is a shaft and the second pivoting portion is a shaft sleeve, and wherein the base body is made of metal and the base cushion is made of a non-metal material with elasticity and electrostatic conductivity so as to increase friction during braking and simultaneously create a path for static electricity to be discharged to the ground of an operating room.

6. The braking device for an operating table base of claim 4, wherein the first pivoting portion is an internal threaded structure and the second pivoting portion is an external threaded structure, and wherein rosette gears that can be mutually coupled are provided on a plurality of respective contact surfaces where the first pivoting portion and the second pivoting portion contact each other.

7. The braking device for an operating table base of claim 1, further comprising a multi-stage adjustable positioning mechanism for adjusting an angle of the supporting leg with respect to the operating table base.

8. The braking device for an operating table base of claim 1, wherein when the lifting mechanism is employed to move the casters upward, the supporting legs go downward to touch the ground, so that the braking device performs a braking action.

9. The braking device for an operating table base of claim 1, wherein when the lifting mechanism is employed to move the casters downward to touch the ground, the supporting legs go upward, so that the braking device performs a brake-releasing action.

10. The braking device for an operating table base of claim 1, wherein the lifting mechanism is employed to move the supporting legs upward or downward.

11. The braking device for an operating table base of claim 10, wherein when the lifting mechanism is employed to move the supporting legs upward, the casters go downward to touch the ground, so that the braking device performs a brake-releasing action.

12. The braking device for an operating table base of claim 10, wherein when the lifting mechanism is employed to move the supporting legs to move downward to touch the ground, the casters go upward, so that the braking device performs a braking action.

13. A braking device for an operating table base, comprising at least two ancillary portions, at least two supporting legs corresponding to the ancillary portions and a lifting mechanism, each supporting leg having a pivoting end and a supporting end distanced from the pivoting end, the operating table base supporting an operation bed whose projected area covers the operating table base, each ancillary portion being fixed either beneath or at an outer side of a turning corner where two outside surfaces of the operating table base intersect, each ancillary portion having a first pivoting portion, each supporting leg having a second pivoting portion at the pivoting end to correspond to the first ancillary portion, the first pivoting portion pivotally connecting to the second pivoting portion, so that each supporting leg rotates with respect to the operating table base, and the supporting ends of the supporting legs extend a supporting area of the operating table base, and underneath the operating table base, a caster is provided at an edge of the operating table base adjacent to each first pivoting portion, and the lifting mechanism is employed to move the casters underneath the operating table base upward or downward.

14. The braking device for an operating table base of claim 13, further comprising a multi-stage adjustable positioning mechanism for adjusting an angle of the supporting leg with respect to the operating table base and the ancillary portion.

15. The braking device for an operating table base of claim 13, wherein two of the supporting legs, by means of the ancillary portions, are provided either beneath or at an outer side of two corners where outside surfaces of the operating table base intersect, the two corners being on the same side as a rear end of the operating table base, and another supporting leg is fixed at an edge of the operating table base, the edge being on the same side as a front end of the operating table.

16. The braking device for an operating table base of claim 13, wherein the supporting leg further comprises a base body and a base cushion, the second pivoting portion being provided on the base body, and wherein the base cushion is positioned in a manner that allows it to be completely disposed on the base body and correspond to an extension of the base body from the second pivoting portion to another one end, so as to prevent a pivot point between each supporting leg and the operating table base from moving inward when each supporting leg rotates to a position parallel to or beneath the operating table base.

17. The braking device for an operating table base of claim 16, wherein the first pivoting portion is a shaft and the second pivoting portion is a shaft sleeve, and wherein the base body is made of metal and the base cushion is made of a non-metal material with elasticity and electrostatic conductivity so as to increase friction during braking and simultaneously create a path for static electricity to be discharged to the ground of an operating room.

18. The braking device for an operating table base of claim 16, wherein the first pivoting portion is an internal threaded structure and the second pivoting portion is an external threaded structure, and wherein rosette gears that can be mutually coupled are provided on the respective contact surfaces where the first pivoting portion and the second pivoting portion contact each other.

* * * * *